US011096254B1

(12) United States Patent
Wang et al.

(10) Patent No.: US 11,096,254 B1
(45) Date of Patent: Aug. 17, 2021

(54) LIGHTING DEVICE USING MULTIPLE SCATTERED LIGHT SOURCES TO CHANGE ILLUMINATION ANGLE AND COLOR

(71) Applicants: GENERAL LUMINAIRE CO., LTD., New Taipei (TW); GENERAL LUMINAIRE (SHANGHAI) CO., LTD., Shanghai (CN); GENERAL LUMINAIRE (KUNSHAN) CO., LTD., Kunshan (CN)

(72) Inventors: Yung-Hong Wang, Shanghai (CN); Chuan-Zhu Pan, Shanghai (CN); Huai-Ling Liu, Shanghai (CN); Yun Zhang, Shanghai (CN); Shuai Li, Kunshan (CN)

( * ) Notice: Subject to any disclaimer, the term of this patent is extended or adjusted under 35 U.S.C. 154(b) by 0 days.

(21) Appl. No.: 17/170,893

(22) Filed: Feb. 9, 2021

(51) Int. Cl.

| | |
|---|---|
| ***H05B 39/04*** | (2006.01) |
| ***H05B 39/00*** | (2006.01) |
| ***H05B 45/20*** | (2020.01) |
| ***H05B 47/19*** | (2020.01) |
| ***H05B 45/10*** | (2020.01) |

(52) U.S. Cl.
CPC ..... *H05B 45/20* (2020.01); *H05B 45/10* (2020.01); *H05B 47/19* (2020.01)

(58) Field of Classification Search
CPC ..... H05B 45/20; H05B 47/19; H05B 45/10
See application file for complete search history.

(56) References Cited

U.S. PATENT DOCUMENTS

| | | | | |
|---|---|---|---|---|
| 8,907,576 | B2 * | 12/2014 | Ferrier | H05B 45/395 315/186 |
| 2014/0035472 | A1 * | 2/2014 | Raj | H05B 45/22 315/185 R |
| 2019/0104583 | A1 * | 4/2019 | Konishi | H05B 45/375 |

* cited by examiner

*Primary Examiner* — Minh D A

(57) ABSTRACT

A lighting device using multiple scattered light sources to change illumination angle and color temperature by adjusting light intensity includes a central light source portion, a peripheral light source portion and an optical lens on a lamp board. The optical lens covers the central and peripheral light source portions. The central light source portion has first cold LEDs and first warm LEDs equidistantly installed near a setting area of the lamp board. The peripheral light source portion has second cold LEDs and second warm LEDs installed within an area range that takes the setting center as center of circle and has a diameter of 6-8 mm. A controller is used to adjust a driving current intensity of the central and peripheral light source portion to adjust the illumination angle and color temperature of the lighting device, and the intensity performance or On/Off state of each LED can be controlled independently.

10 Claims, 8 Drawing Sheets

Average beam angle(50%):40.2°

Light intensity unit: cd

—— C0/180

—— C30/210

------ C60/240

—-— C90/270

Average beam angle(50%):26.2°

Light intensity unit: cd

—— C0/180

—— C30/210

------ C60/240

—-— C90/270

Average beam angle(50%):20.6°

Light intensity unit: cd
C0/180
C30/210
C60/240
C90/270

Average beam angle(50%):12.9°

Light intensity unit: cd

—— C0/180

—— C30/210

------ C60/240

—-— C90/270

LIGHTING DEVICE USING MULTIPLE SCATTERED LIGHT SOURCES TO CHANGE ILLUMINATION ANGLE AND COLOR

BACKGROUND

Technical Field

The present invention relates to the technical field of lighting devices. More particularly, the present invention relates to a lighting device using multiple scattered light sources to change illumination angle and color temperature by adjusting light intensity. The lighting device includes a plurality of light emitting diodes (LEDs) covered under a single optical lens, and the intensity of at least one of the LEDs is adjusted to achieve the effect of adjusting the illumination angle of the lighting device.

Description of Related Art

LED with its advantages of energy saving, stable performance and long service life has been extensively used as a light source for various lighting products, and LED light board manufacturers have developed a series of LED light boards which are provided for downstream lamp manufacturers to manufacture a lighting device by installing electrical components or structural components directly onto the light boards. Due to the limitation of the body structure and packaging method of the LED, the lighting device using the LED as a light source generally has a smaller and more concentrated illumination angle, so that the lighting device is usually equipped with a mirror or an LED of the lighting device is equipped with an optical lens to adjust the illumination angle, so that the lighting effect of the lighting device can meet market and consumer requirements.

In the conventional manufacturing operation, regardless of the LED light board manufacturers directly installing the optical lens on the LED light board or the lamp manufacturers connecting the optical lens with the LED light board by themselves, an LED of the LED light board covers the optical lens, and it is necessary to adjust the illumination angle of the lighting device by adjusting the height and distance between the LED installed on the LED light board and the optical lens. In other words, the light beam of the LED is incident on the transmission distance of the optical lens. In addition, various kinds of lighting devices are provided to meet market consumer requirements, and thus the structural design of the LED light board and the optical lens is also uncountable. As a result, it is a common practice for each manufacturer to adjust the mechanical installation position of the optical lens repeatedly. In this way, the complexity and efficiency of operations cannot be further improved no matter whether such operations are for an upstream manufacturer in the production process or for a downstream manufacturer in the assembly process, which is not conducive to the expectation of further development of the industry.

In view of the aforementioned drawbacks, it is a main subject of the present invention to provide a novel design of a structure different from the structure installed between the LED and the optical lens of the conventional lighting device, so that the illumination angle of the lighting device can be adjusted without the need of adjusting the height and distance between the LED and the optical lens.

SUMMARY

Therefore, it is a primary objective of the present disclosure to provide a lighting device with an adjustable illumination, and a plurality of LEDs scattered and covered in a single optical lens can be used to adjust the light intensity and achieve the effect of changing the illumination angle of the lighting device.

To achieve the aforementioned and other objectives, the present invention discloses a lighting device using multiple scattered light sources to change illumination angle and color temperature by adjusting light intensity, and the lighting device comprises a lamp board, a central light source portion, a peripheral light source portion, an optical lens and a controller. The lamp board has a light source driver circuit, a setting area defined on the lamp board, and a setting center defined in the setting area. The central light source portion has a plurality of first cold LEDs and a plurality of first warm LEDs, and the first cold LEDs and the first warm LEDs are installed in the setting area of the lamp board and electrically coupled to the light source driver circuit; wherein the first cold LEDs and the first warm LEDs are equidistantly installed near the setting center. The peripheral light source portion has a plurality of second cold LEDs and a plurality of second warm LEDs, and the second cold LEDs and the second warm LEDs are installed in the setting area of the lamp board and electrically coupled to the light source driver circuit; wherein the second cold LEDs and the second warm LEDs are installed within an area that takes the setting center as a center of circle and has a diameter of 6-8 mm. The optical lens has a light entry chamber concavely formed on the optical lens, and the optical lens is installed on the lamp board, and the light entry chamber covers the central light source portion and the peripheral light source portion. The controller is telecommunicatively coupled to the light source driver circuit and provided for adjusting a driving current intensity of the central light source portion and the peripheral light source portion to adjust the illumination angle and color temperature of the lighting device; wherein the driving current intensity of the central light source portion has a negative correlation with the illumination angle of the lighting device. When the controller is used to adjust the driving current of the central light source portion or the peripheral light source portion, the driving currents of the first cold LEDs, the first warm LEDs, the second cold LEDs, and the second warm LEDs are controlled independently to have the same or different intensity performances or On/Off state.

Wherein, the quantity of the installed first cold LEDs is equal to the quantity of the installed first warm LEDs, and the quantity of the installed second cold LEDs is equal to the quantity of the installed second warm LEDs. The first cold LEDs and the first warm LEDs are staggered respectively to form the central light source portion, and the second cold LEDs and the second warm LEDs are staggered respectively to form the peripheral light source portion. The central light source portion includes four staggered first cold LEDs and first warm LEDs, and the peripheral light source portion includes eight staggered second cold LEDs and second warm LEDs. The distance between each first cold LED and each corresponding first warm LED of the central light source portion is less than 0.2 mm, and the installation distance is preferably 0.15 mm, and the peripheral light source portion is preferably installed within an area range that takes the setting center as a center of circle and has a diameter of 7 mm.

In addition, each of the first cold LEDs, first warm LEDs, second cold LEDs, and second warm LEDs is a flip chip LED, a surface mount technology (SMT) LED, or a chip on board (COB) LED. The light source driver circuit and the controller have a first wireless communication element and a second wireless communication element respectively, and the first wireless communication element is connected to the second wireless communication element via a wireless communication. The first wireless communication element is connected to the second wireless communication element via a Near Field Communication (NFC), Bluetooth (BT), Zigbee or Wi-Fi (Wireless Fidelity) wireless network. Each first warm LED and each second warm LED are LEDs with a color temperature of 2700K, and each first cold LED and each second cold LED are LEDs with a color temperature of 5700K.

In summation of the description above, the lighting device is unlike the conventional light device having a structure installed between the lens and the light source, but the lighting device of the present invention provides the LEDs having a cold light and a warm light and installed in a light entry chamber of the optical lens, and the LEDs are staggered in the central light source portion and the peripheral light source portion. The driving current intensity of each LED can be changed to adjust the light intensity of the central light source portion and the peripheral light source portion, so that after the emitted lights from the two light source portions are matched with each other, the overall illumination angle can be changed without the need of moving the optical lens to adjust the distance between the light source portion and the light source, so as to increase the efficiency and reduce the complexity of the operation. It is noteworthy that even if the LED is highly specialized and miniaturized drastically due to the rapid advancement of semiconductor process technology, so that a single packaged LED may have the RGB chip capable of emitting multiple color light sources at the same time. It is noteworthy that such LED should still be regarded as a single LED and known to be different from the LED adopting scattered cold and warm lights as described in this invention.

DESCRIPTION OF THE EMBODIMENTS

The accompanying drawings are included to provide a further understanding of the disclosure, and are incorporated in and constitute a part of this specification. The drawings illustrate embodiments of the disclosure and, together with the description, serve to explain the principles of the disclosure.

Figure 1:
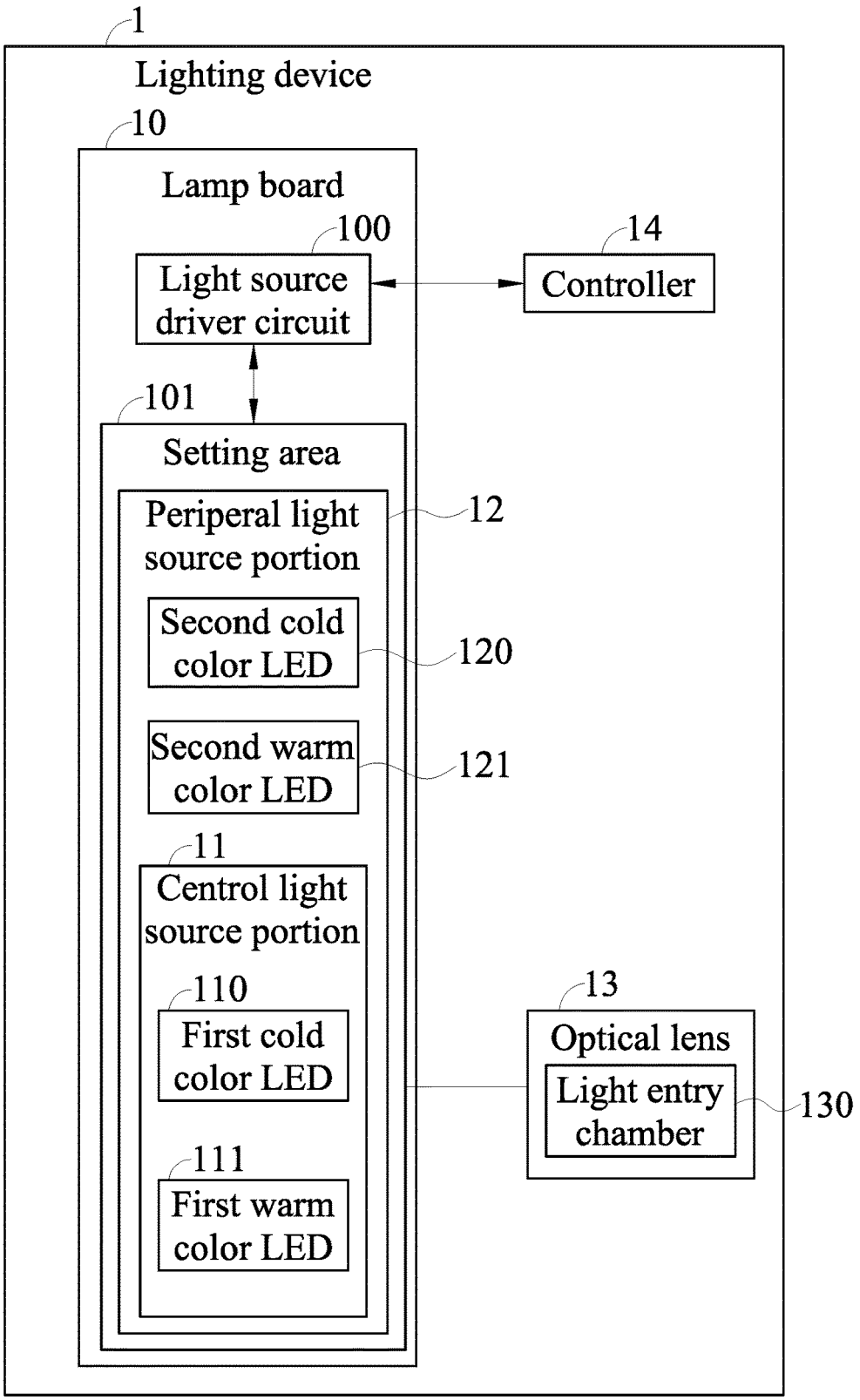
FIG. 1 is a schematic block diagram of a lighting device in accordance with a first preferred embodiment of the present invention.

With reference to FIG. 1 for the schematic block diagram of a lighting device using multiple scattered light sources to change illumination angle and color temperature by adjusting light intensity in accordance with the first preferred embodiment of the present invention, the lighting device 1 comprises a lamp board 10, a central light source portion 11, a peripheral light source portion 12, an optical lens 13 and a controller 14. The lamp board 10 has a light source driver circuit 100, a setting area 101 defined on the lamp board 10, and a setting center defined in the setting area 101. The central light source portion 11 has a plurality of first cold LEDs 110 and a plurality of first warm LEDs 111, and the first cold LEDs 110 and the first warm LEDs 111 are installed in the setting area 101 of the lamp board 10 and electrically coupled to the light source driver circuit 100, and the first cold LEDs 110 and the first warm LEDs 111 are equidistantly installed near the setting center. The peripheral light source portion 12 has a plurality of second cold LEDs 120 and a plurality of second warm LEDs 121, and the second cold LEDs 120 and the second warm LEDs 121 are installed in the setting area 101 of the lamp board 10 and electrically coupled to the light source driver circuit 100, and the second cold LEDs 120 and the second warm LEDs 121 are installed in an area range that takes the setting center as a center of circle and has a diameter of 6-8 mm. The optical lens 13 has a light entry chamber 130 concavely formed on the optical lens 13, and the optical lens 13 is installed on the lamp board 10, and the light entry chamber 130 covers the central light source portion 11 and the peripheral light source portion 12.

The controller 14 is telecommunicatively coupled to the light source driver circuit 100 and provided for adjusting the driving current intensity of the central light source portion 11 and the peripheral light source portion 12 in order to adjust the illumination angle and color temperature of the lighting device 1, and the driving current intensity of the central light source portion 11 is negatively correlated with the illumination angle of the lighting device 1. When the controller 14 is provided for adjusting the driving current of the central light source portion 11 or the peripheral light source portion 12, the driving currents of the first cold LEDs 110, the first warm LEDs 111, the second cold LEDs 120, the second warm LEDs 121 can be controlled independently to have a same or different intensity performances or On/Off state.

Figure 2:
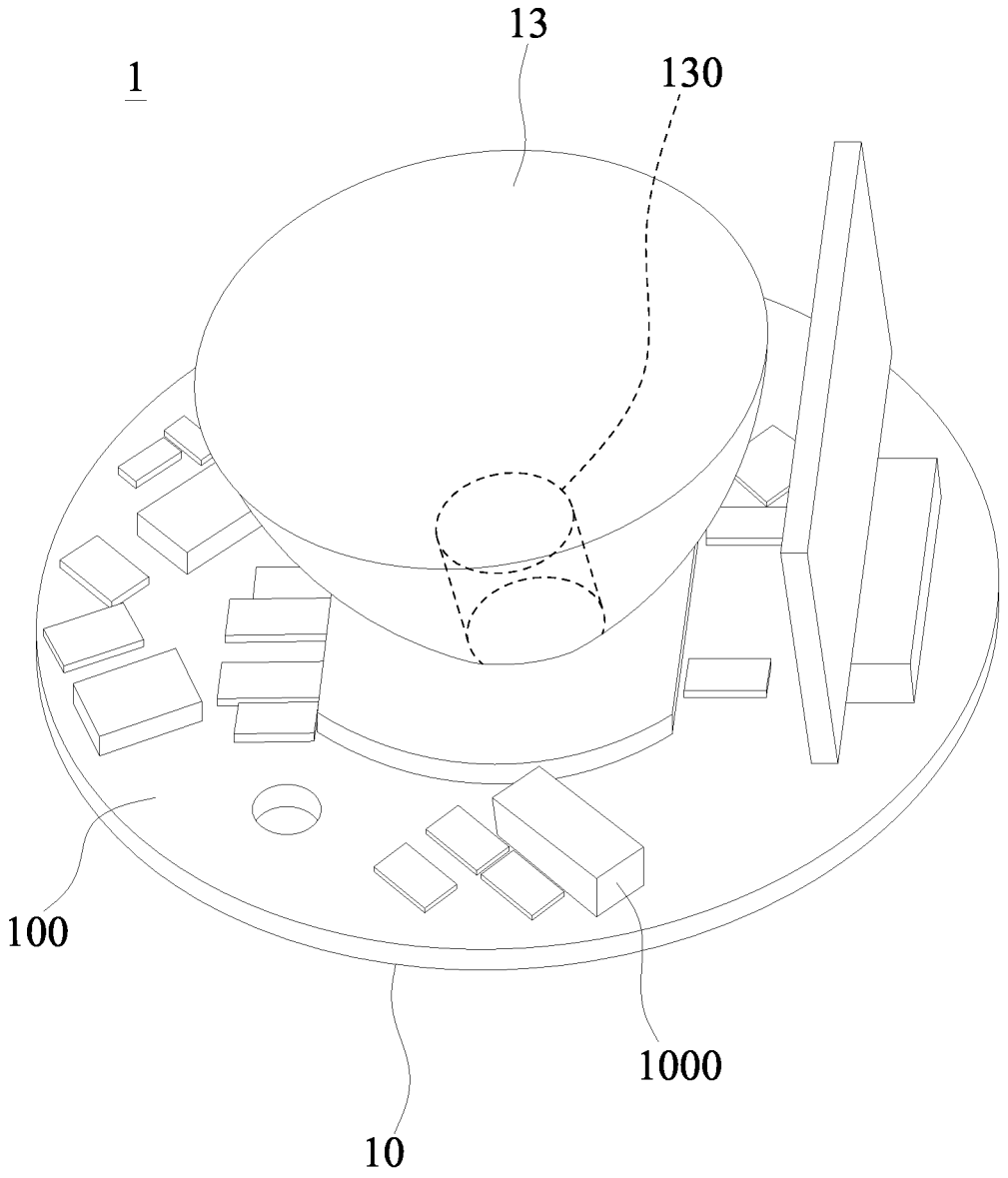
FIG. 2 is a perspective view of a lighting device in accordance with a second preferred embodiment of the present invention.
Figure 3:
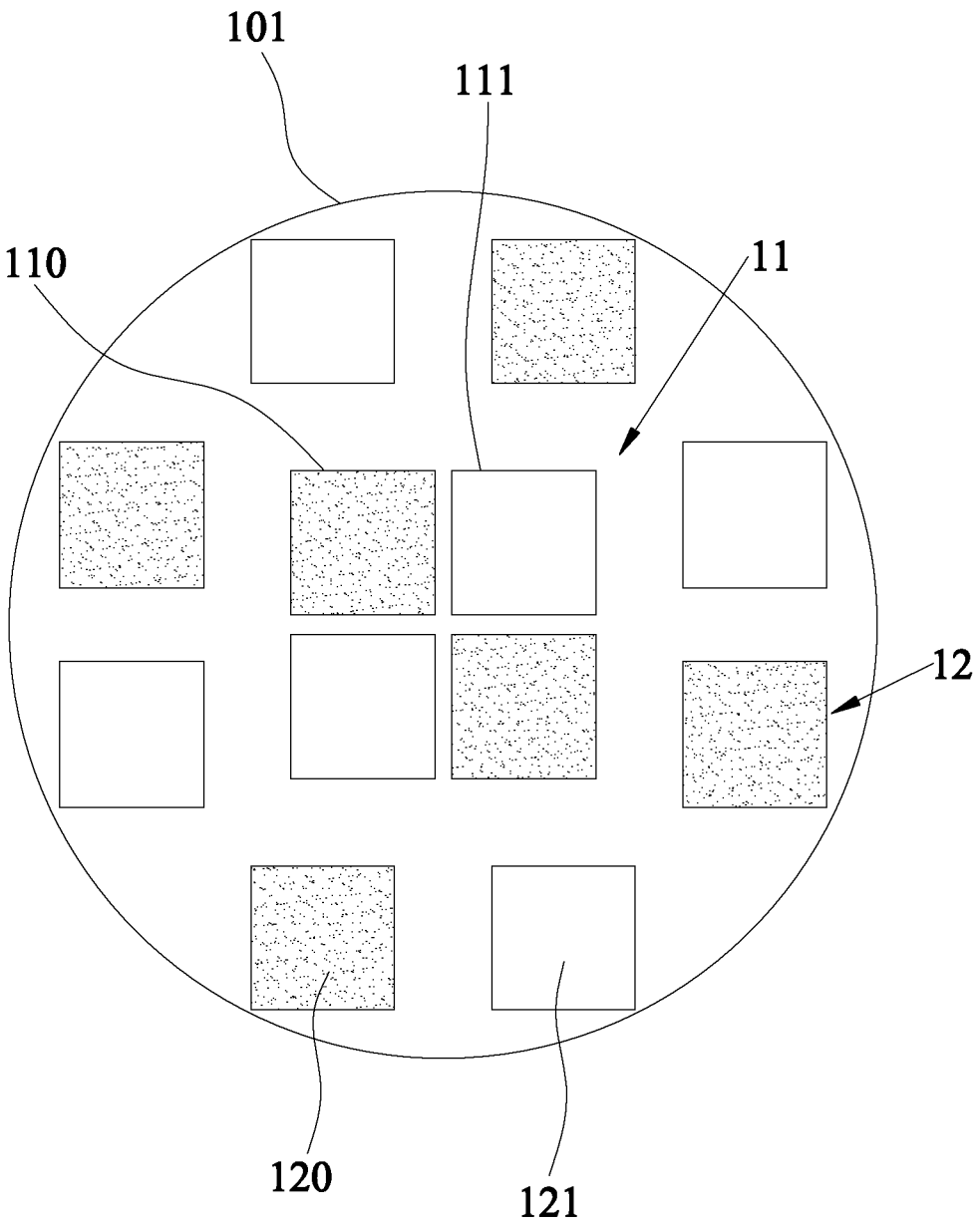
FIG. 3 is a schematic view showing a setting area of the lighting device in accordance with the second preferred embodiment of the present invention.
Figure 4:
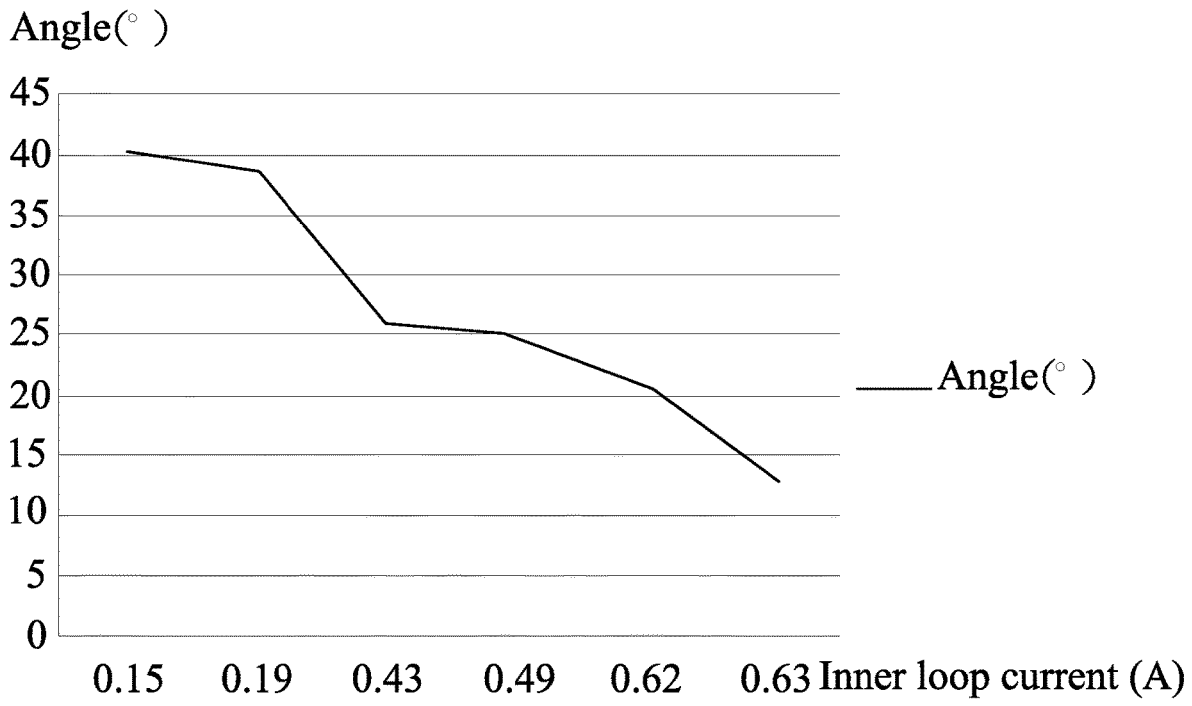
FIG. 4 is a graph showing the relationship between a driving current and an illumination angle of the lighting device in accordance with the second preferred embodiment of the present invention.
Figure 5:
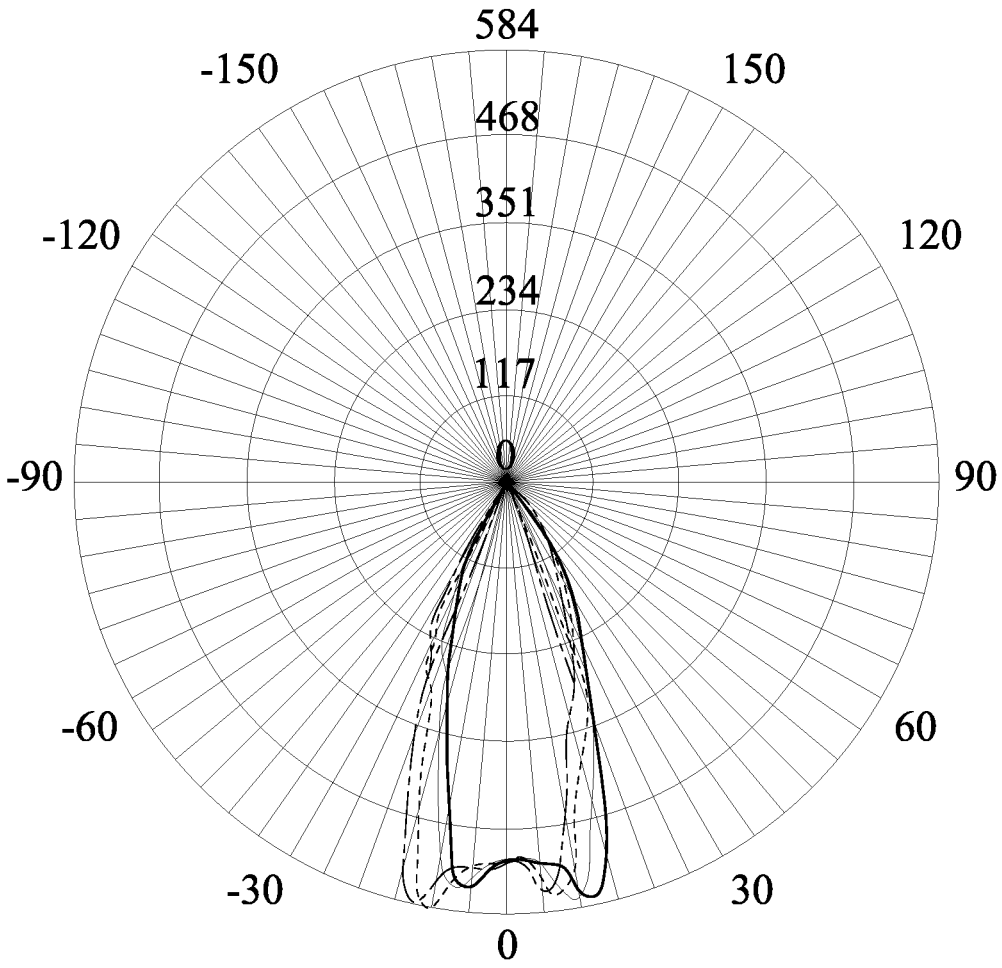
FIG. 5 is a light distribution curve of a test group II in accordance with the second preferred embodiment of the present invention.
Figure 6:
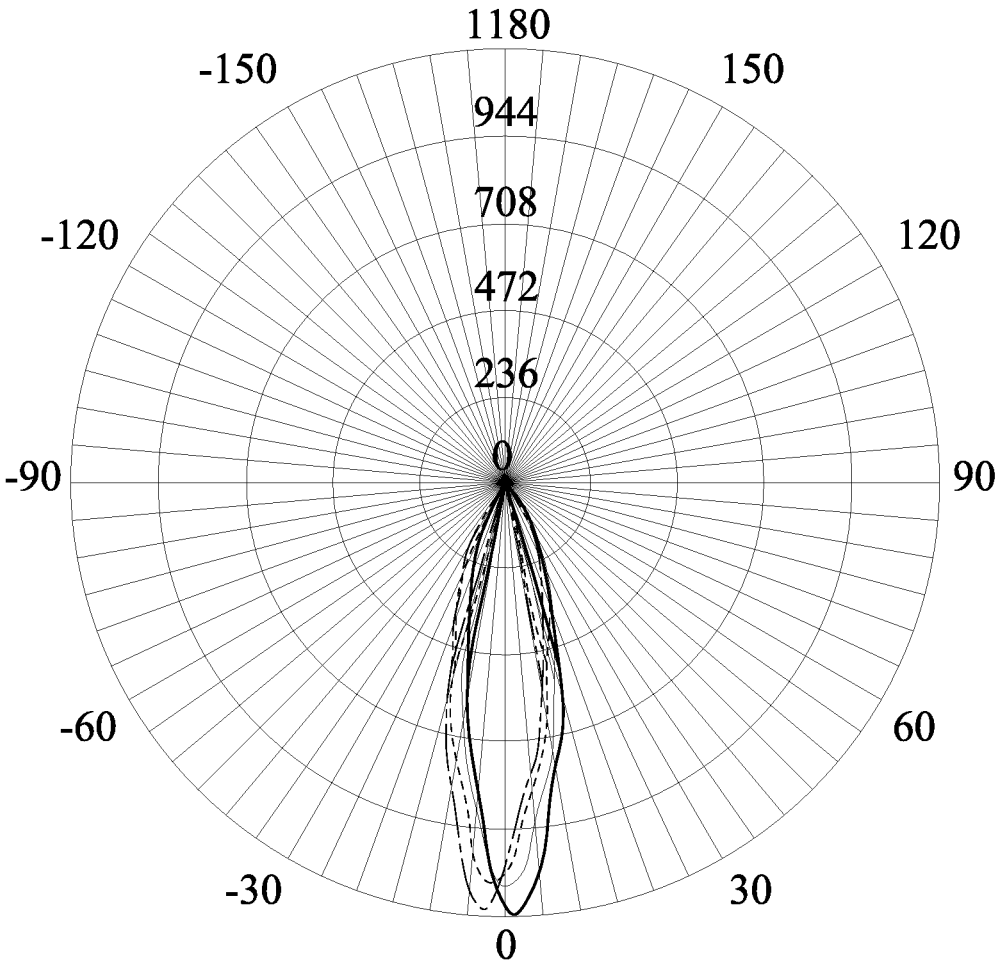
FIG. 6 is a light distribution curve of a test group III in accordance with the second preferred embodiment of the present invention.
Figure 7:
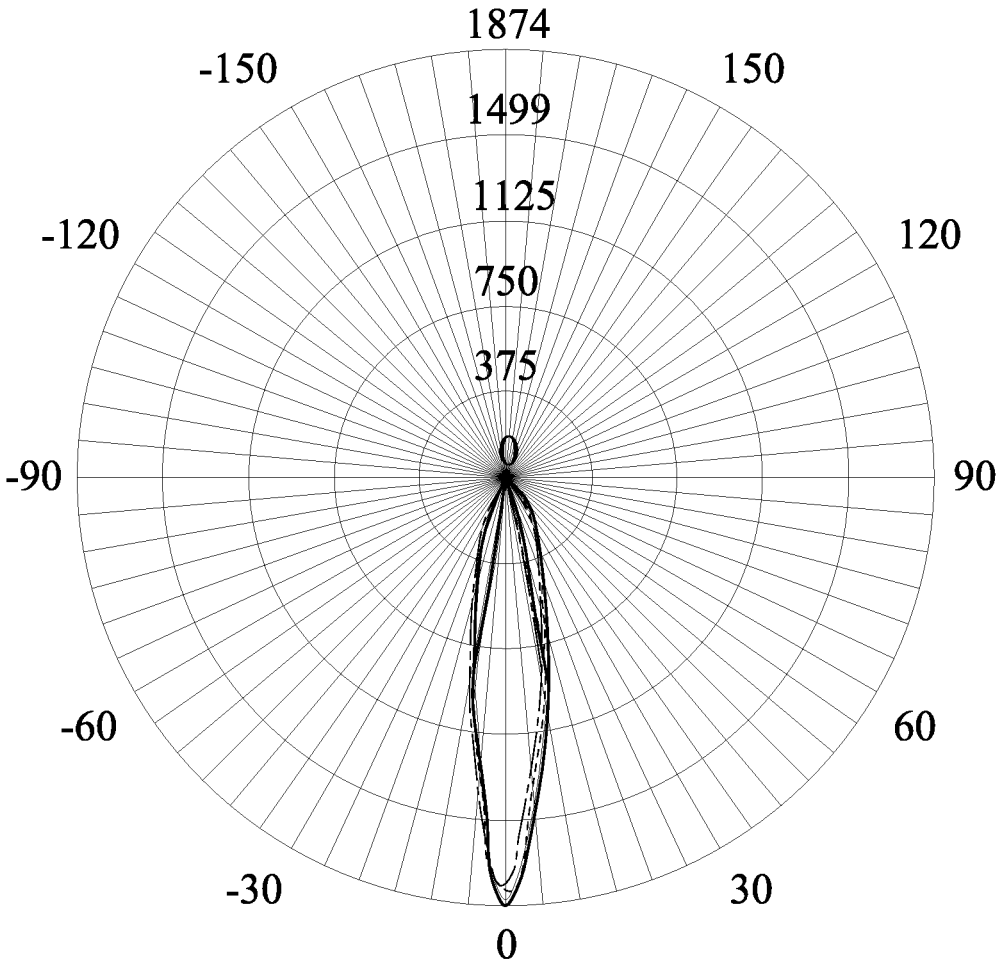
FIG. 7 is a light distribution curve of a test group V in accordance with the second preferred embodiment of the present invention.
Figure 8:
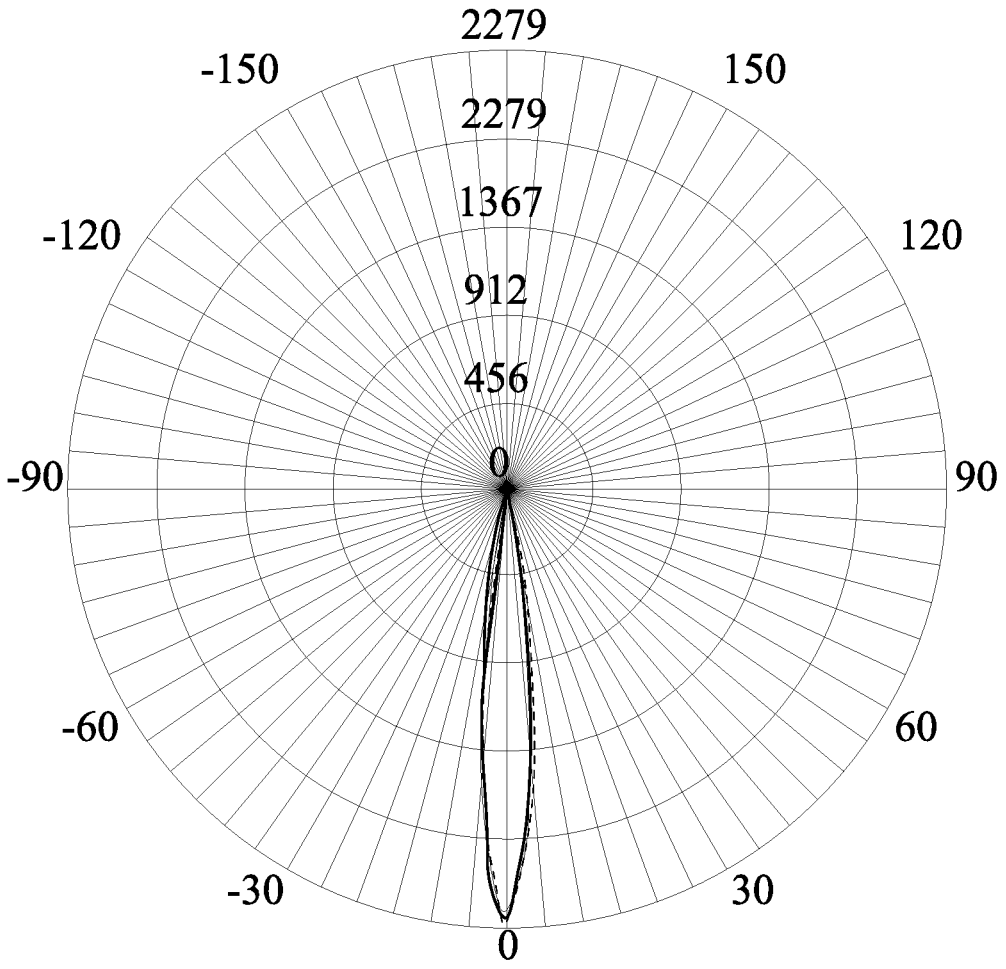
FIG. 8 is a light distribution curve of a test group VI in accordance with the second preferred embodiment of the present invention.

With reference to FIGS. 2 and 3 for the schematic views of the lighting device in accordance with the second preferred embodiment of the present invention respectively, the lighting device 1 has a plurality of fixed light sources arranged with a scattered configuration, and the light intensity can be adjusted to change the illumination angle and color temperature, and the lighting device 1 comprises a lamp board 10, a central light source portion 11, a peripheral light source portion 12, an optical lens 13 and a controller (not shown in the figure), and the lamp board 10 has a setting area 101 defined on the lamp board 10, and a setting center defined in the setting area 101. The optical lens 13 has a main body which is substantially bowl-shaped, and has a light entry chamber 130 concavely formed on the main body, and the outer surface of the main body has a diamond-patterned structure, and the top surface of the light entry chamber has a dot structure or an atomized structure. The central light source portion 11 and the peripheral light source portion 12 are disposed in the setting area 101, and the optical lens 13 is installed on the lamp board 10, and the light entry chamber 130 covers the central light source portion 11 and the peripheral light source portion 12.

In addition, the lamp board 10 has a light source driver circuit 100, and the light source driver circuit 100 has a first wireless communication element 1000, and the controller has a second wireless communication element, wherein the second wireless communication element can be connected to the first wireless communication element 1000 via a NFC, BT, Zigbee or Wi-Fi wireless communication. The central light source portion 11 has a plurality of first cold LEDs 110 and a plurality of first warm LEDs 111, and the quantity of the installed first cold LEDs 110 is equal to the quantity of the installed first warm LEDs 111. The first cold LEDs 110 and the first warm LEDs 111 are installed in the setting area 101 and electrically coupled to the light source driver circuit 100, and the first cold LEDs 110 and the first warm LEDs 111 are equidistantly installed near the setting center. The peripheral light source portion 12 has a plurality of second cold LEDs 120 and a plurality of second warm LEDs 121, and the quantity of the installed second cold LEDs 120 is equal to the quantity of the installed second warm LEDs 121. The second cold LEDs 120 and the second warm LEDs 121 are installed in the setting area 101 and electrically coupled to the light source driver circuit 100, and the second cold LEDs 120 and the second warm LEDs 121 are installed in an area range that takes the setting center as a center of circle and has a diameter of 6-8 mm. It is noteworthy that each of the first cold LEDs 110, the first warm LEDs 111, the second cold LEDs 120, and the second warm LEDs 121 is a Flip Chip LED, a SMT LED, or a COB LED.

In this embodiment, each first warm LED 111 and each second warm LED 121 are LEDs with a color temperature of 2700K, and each first cold LED 110 and each second cold LED 111 are LEDs with a color temperature of 5700. The first cold LEDs 110 and the first warm LEDs 111 are staggered respectively to form the central light source portion 11. For example, the central light source portion 11 includes four staggered first cold LEDs 110 and first warm LEDs 111. The second cold LEDs 120 and the second warm LEDs 121 are staggered respectively to form the peripheral light source portion 12. For example, the peripheral light source portion 12 includes eight staggered second cold LEDs 120 and second warm LEDs 121. In addition, the distance between each first cold LED 110 and each corresponding first warm LED 111 of the central light source portion 11 is less than 0.2 mm, and preferably equal to 0.15 mm, and the peripheral light source portion 12 is preferably installed within an area range that takes the setting center as a center of circle and has a diameter of 7 mm.

When the controller is used to adjust the driving current intensity of the central light source portion 11 and the peripheral light source portion 12, the illumination angle and the color temperature of the lighting device 1 are adjusted, and the driving current intensity of the central light source portion 11 is negatively correlated with the illumination angle of the lighting device 1 as shown in Table 1 and FIGS. 4 to 8, the aforementioned LED installation conditions of the lighting device 1 is used to conduct actual tests and the test results are recorded. Further, when the controller is used to adjust the driving current of the central light source portion 11 or the peripheral light source portion 12, the driving currents of the first cold LEDs 110, the first warm LEDs 111, the second cold LEDs 120, and the second warm LEDs 121 are controlled independently to have a same or different intensity performance or On/Off state.

TABLE 1

| | | Test Group | | | | | |
|---|---|---|---|---|---|---|---|
| | | I | II | III | IV | V | VI |
| current (A) | Central light source portion | 0.15 | 0.19 | 0.43 | 0.49 | 0.62 | 0.63 |
| | Peripheral light source portion | 0.97 | 0.97 | 0.97 | 0.97 | 0.97 | 0 |
| Angle (°) | | 40.2 | 38.5 | 26.2 | 24.8 | 20.6 | 12.9 |

What is claimed is:

1. A lighting device using multiple scattered light sources to change illumination angle and color temperature by adjusting light intensity, comprising:

a lamp board, having a light source driver circuit, a setting area defined on the lamp board, and a setting center defined in the setting area;

a central light source portion, having a plurality of first cold LEDs and a plurality of first warm LEDs, and the first cold LEDs and the first warm LEDs being installed in the setting area of the lamp board and electrically coupled to the light source driver circuit;

wherein the first cold LEDs and the first warm LEDs near the setting center are equidistantly installed;

a peripheral light source portion, having a plurality of second cold LEDs and a plurality of second warm LEDs, and the second cold LEDs and the second warm LEDs being installed in the setting area of the lamp board and electrically coupled to the light source driver circuit; wherein the second cold LEDs and the second warm LEDs are installed within an area range that takes the setting center as a center of circle and has a diameter of 6-8 mm;

an optical lens, having a light entry chamber concavely formed thereon, and the optical lens being installed on the lamp board, and the light entry chamber covering the central light source portion and the peripheral light source portion; and a controller, telecommunicatively coupled to the light source driver circuit, for adjusting a driving current intensity of the central light source portion and the peripheral light source portion by the controller in order to adjust an illumination angle and a color temperature of the lighting device; wherein the driving current intensity of the central light source portion and the illumination angle of the lighting device are negatively correlated, and when the controller is used to adjust the driving current of the central light source portion or the peripheral light source portion, the driving currents of the first cold LEDs, the first warm LEDs, the second cold LEDs, and the second warm LEDs are controlled independently to have a same or different intensity performance or On/Off state.

2. The lighting device as claimed in claim 1, wherein the installed quantity of the first cold LEDs is equal to the installed quantity of the first warm LEDs, and the installed quantity of the second cold LEDs is equal to the installed quantity of the second warm LEDs.

3. The lighting device as claimed in claim 2, wherein the first cold LEDs and the first warm LEDs are staggered respectively to form the central light source portion, and the second cold LEDs and the second warm LEDs are staggered respectively to form the peripheral light source portion.

4. The lighting device as claimed in claim 3, wherein the central light source portion includes four of the staggered first cold LEDs and first warm LEDs, and the peripheral light source portion includes eight of the staggered second cold LEDs and second warm LEDs.

5. The lighting device as claimed in claim 4, wherein the distance between each first cold LED and each corresponding first warm LED of the central light source portion is less than 0.2 mm.

6. The lighting device as claimed in claim 5, wherein the distance between each first cold LED and each corresponding first warm LED of the central light source portion is preferably 0.15 mm, and the peripheral light source portion is preferably installed within an area range that takes the setting center as a center of circle and has a diameter of 7 mm.

7. The lighting device as claimed in claim 6, wherein each of the first cold LEDs, the first warm LEDs, the second cold LEDs, and the second warm LEDs is a flip chip LED, a surface mount technology (SMT) LED, or a chip on board (COB) LED.

8. The lighting device as claimed in claim 7, wherein the light source driver circuit and the controller respectively have a first wireless communication element and a second wireless communication element, and the first wireless communication element is connected to the second wireless communication element via a wireless communication.

9. The lighting device as claimed in claim 8, wherein the second wireless communication element is connected to the first wireless communication element via a near field communication (NFC), Bluetooth, Zigbee or Wi-Fi wireless communication.

10. The lighting device as claimed in claim 9, wherein each first warm LED and each second warm LED are LEDs with a color temperature of 2700K, and each first cold LED and each second cold LED are LEDs with a color temperature of 5700K.

* * * * *